US008723108B1

(12) United States Patent
Ugarov

(10) Patent No.: US 8,723,108 B1
(45) Date of Patent: May 13, 2014

(54) TRANSIENT LEVEL DATA ACQUISITION AND PEAK CORRECTION FOR TIME-OF-FLIGHT MASS SPECTROMETRY

(71) Applicant: Agilent Technologies, Inc., Loveland, CO (US)

(72) Inventor: Michael Ugarov, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 18 days.

(21) Appl. No.: 13/656,429

(22) Filed: Oct. 19, 2012

(51) Int. Cl.
*H01J 49/26* (2006.01)

(52) U.S. Cl.
USPC ..... 250/287; 250/281; 250/282; 702/27; 702/28

(58) Field of Classification Search
USPC ..... 250/281, 282, 286, 287; 702/19, 22, 26, 702/27, 28
See application file for complete search history.

(56) References Cited

U.S. PATENT DOCUMENTS

| | | | | |
|---|---|---|---|---|
| 5,367,162 | A | 11/1994 | Holland et al. | |
| 5,886,345 | A | 3/1999 | Koster | |
| 6,188,064 | B1 | 2/2001 | Koster | |
| 6,373,052 | B1 | 4/2002 | Hoyes et al. | |
| 7,781,729 | B2 | 8/2010 | Wang et al. | |
| 2005/0080578 | A1 | 4/2005 | Klee | |
| 2011/0240841 | A1* | 10/2011 | Lange | 250/282 |
| 2012/0109537 | A1* | 5/2012 | Makarov | 702/27 |

* cited by examiner

*Primary Examiner* — Nicole Ippolito

(57) ABSTRACT

Methods, apparatus and systems for acquiring spectrometric data from analyte ions implement transient-level data acquisition and peak correction in a time-of-flight mass spectrometer. Transient spectra including analyte peaks and reference mass peaks are recorded, from which a set of averaged peak centroids of the reference masses is generated. The peaks of reference masses in each transient spectrum are compared to the averaged peak centroids. From this comparison, an appropriate correction function is applied to each transient spectrum to correct the positions of the analyte peaks in each transient spectrum. The corrected transient spectra are then summed to obtain a corrected averaged spectrum.

18 Claims, 5 Drawing Sheets

TRANSIENT LEVEL DATA ACQUISITION AND PEAK CORRECTION FOR TIME-OF-FLIGHT MASS SPECTROMETRY

TECHNICAL FIELD

The present invention relates generally to acquisition of spectrometric data utilizing time-of-flight mass spectrometry, and more specifically to correcting data to account for factors limiting mass resolution.

BACKGROUND

A mass spectrometry (MS) system in general includes an ion source for ionizing components of a sample of interest, a mass analyzer for separating the ions based on their differing mass-to-charge ratios (or m/z ratios, or more simply "masses"), an ion detector for counting the separated ions, and electronics for processing output signals from the ion detector as needed to produce a user-interpretable mass spectrum. Typically, the mass spectrum is a series of peaks indicative of the relative abundances of detected ions as a function of their m/z ratios. The mass analyzer may be a time-of-flight (TOF) analyzer. Ions produced by the ion source are transmitted into the TOF analyzer where they are mass-resolved based on their flight times to the detector.

An important performance criterion of a mass analyzer is its mass resolution or resolving power. A TOF analyzer is often considered to have limited mass resolution in comparison to certain other types of mass analyzers. Several factors or effects contribute to the limited mass resolution of a TOF analyzer. Major factors include the width of the ion detector pulse, peak broadening due to voltage instability, mechanical misalignments, lack of detector flatness (surface unevenness), pulser jitter (the ion pulser of the TOF analyzer), scattering on grids utilized in the TOF analyzer, and turn-around time (the spread in ion arrival at the detector due to ions entering the pulser at different angles, resulting in some ions having a velocity component opposite to the direction of pulsed extraction). One could improve the mass resolution if at least one of these factors (preferably the factor that contributes the most) is reduced. The factors may be conceptually divided into two groups, which will be referred to herein as group I factors and group II factors. Group I factors include factors that affect all ions in a similar fashion during one TOF period (i.e., one TOF cycle, or "transient"). Examples of group I factors include low-frequency high-voltage (HV) instability, mechanical vibration, and pulser jitter. Group II factors include factors that affect each ion in a transient in an intrinsically different way. Examples of group II factors include turn-around time and detector surface unevenness.

If one were to examine the spectrum contained in a given transient, the shifts of ion peaks in it due to group I factors would be correlated in the sense that all peaks due to group I factors would appear to be shifted in the same direction, whereas the shifts of ion peaks due to group II factors would not be correlated. In the present disclosure, it is proposed that if a transient-level correction could be made based on the correlation of the shifts due to group I factors, the resulting peak width could be reduced by a significant amount and the mass resolution could be increased accordingly.

Techniques for peak correction known in the art rely on correction of peak position based on the position of the peaks of reference mass ions (ions produced from reference compounds, or calibrants, of known structure, composition and m/z ratios) observed in the spectra. Typically, the correction is performed after a complete spectrum is acquired (i.e., the accumulation of data from multiple transients processed in the TOF analyzer). The known techniques may be effective in compensating for variations in the system parameters that transpire over relatively long periods of time, for example, a period of over 100 ms and typically over several seconds. As a result, correcting peak position according to known techniques may improve mass accuracy, but not mass resolution. In other known techniques, peak data may be corrected based on a single transient digitization to reduce the width of the detector response, which may lead to some improvement in mass resolution. However, these latter techniques do nothing to compensate for the drift of an instrument parameter between individual transients.

Therefore, there is a need for providing a solution for implementing peak corrections at the transient level, and for correcting multiple transients, so as to compensate for various sources of instrument instabilities, including those occurring over short time periods.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a method for correcting spectral data in a time-of-flight mass spectrometer (TOF MS) includes: introducing a mixture of analyte ions and one or more reference mass (RM) ions into the TOF MS; recording a plurality of transient spectra comprising analyte peaks corresponding to detected analyte ions and one or more RM peaks corresponding to one or more detected RM ions; summing the recorded transient spectra to obtain a compound spectrum; centroiding the RM peaks of the compound spectrum to obtain a set of averaged peak centroids (APC); comparing positions of one or more RM peaks in each recorded transient spectrum to corresponding RM centroids in the APC; based on the comparison, applying a correction function to the respective recorded transient spectra to obtain respective corrected transient spectra; and summing the corrected transient spectra to obtain a corrected averaged spectrum comprising corrected peaks of the analyte ions detected.

According to another embodiment, a mass spectrometry system includes a system controller communicating with the TOF MS, and is configured to perform any of the methods disclosed herein.

According to another embodiment, a computer-readable storage medium includes instructions for performing any of the methods disclosed herein.

According to another embodiment, a mass spectrometry system includes the computer-readable storage medium.

According to another embodiment, a mass spectrometry system includes a TOF MS and a system controller. The TOF MS includes an ion detector configured for detecting the arrival of analyte ions and reference mass (RM) ions. In some embodiments, the system controller includes a recorder and a processor. The recorder may be configured for receiving signals from the ion detector corresponding to detection of analyte ions and RM ions, and recording a plurality of transient spectra comprising analyte peaks corresponding to detected analyte ions and one or more RM peaks corresponding to one or more detected RM ions. The processor may be configured for: summing the recorded transient spectra to obtain a compound spectrum; centroiding the RM peaks of the compound spectrum to obtain a set of averaged peak centroids (APC);

comparing positions of one or more RM peaks in each recorded transient spectrum to corresponding RM centroids in the APC; based on the comparison, applying a correction function to the respective recorded transient spectra to obtain respective corrected transient spectra; and summing the corrected transient spectra to obtain a corrected averaged spectrum comprising corrected peaks of the analyte ions detected.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
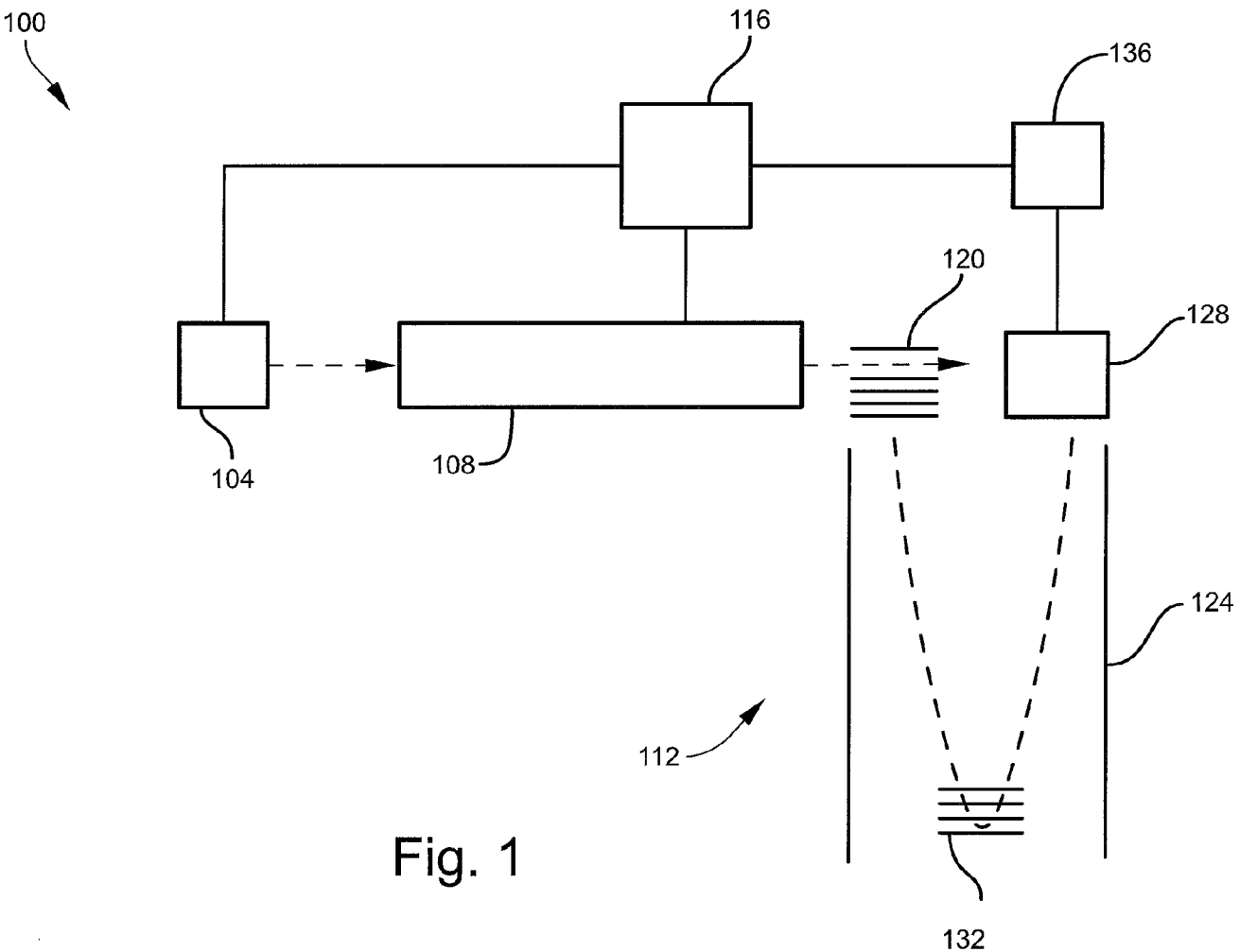
FIG. 1 is a schematic view of an example of a mass spectrometer (MS) system that may be utilized in the implementation of methods described herein.

FIG. 1 is a schematic view of an example of a mass spectrometer (MS) system 100 that may be utilized in the implementation of methods described herein. The MS system 100 generally includes an ion source 104, an ion processing section 108, a time-of-flight mass spectrometer (TOF MS) 112, and a system controller 116. The operation and design of specific components of TOF-based MS systems are generally known to persons skilled in the art and thus need not be described in detail herein. Instead, certain components are briefly described herein to facilitate an understanding of the methods presently disclosed.

The ion source 104 may be any type of continuous-beam or pulsed ion source suitable for MS operations. Examples of ion sources include, but are not limited to, electrospray ionization (ESI) sources, other atmospheric pressure ionization (API) sources, photo-ionization (PI) sources, electron ionization (EI) sources, chemical ionization (CI) sources, laser desorption ionization (LDI) sources, and matrix-assisted laser desorption ionization (MALDI) sources. Depending on the type of ionization implemented, the ion source 104 may reside in a vacuum chamber or may operate at or near atmospheric pressure. Sample material to be analyzed may be introduced to the ion source 104 by any suitable means, including hyphenated techniques in which the sample material is the output of an analytical separation instrument such as, for example, a gas chromatography (GC) or liquid chromatography (LC) instrument (not shown).

The ion processing section 108 is a schematic representation one more ion processing components that may be included between the ion source 104 and the TOF MS 112 in accordance with the design of the MS system 100, the type of sample to be analyzed, and the type of experiments to be conducted. Examples of ion processing components may include, but are not limited to, an interface with the ion source 104 for receiving ions therefrom, mass filters, ion traps, collision cells, multipole ion guides, various ion optics for focusing the ion beam and controlling the transport and energy of ions, an interface for admitting ions into the TOF MS 112, etc. Pressure in the ion processing section 108 may be controlled by one or more different vacuum stages.

The TOF MS 112 includes an ion pulser 120, a flight tube 124, and an ion detector 128. The ion pulser 120 includes a set of electrodes (e.g., grids or apertured plates) communicating with voltage sources for applying a pulsed electric field sufficient to extract ions from the ion pulser 120 into the flight tube 124. The flight tube 124 defines an electric field-free drift region through which ions drift toward the ion detector 128. The ion detector 128 may be any detector suitable for use in the TOF MS 112, a few non-limiting examples being an electron multiplier with a flat dynode and a microchannel plate detector (MCP). The ion detector 128 detects the arrival of ions (or counts the ions) and produces representative ion detection signals. In the present example, the TOF MS 112 is arranged as an orthogonal TOF MS—that is, the direction in which ions are extracted and drift through the flight tube 124 is generally orthogonal (or at least at an appreciable angle) to the direction in which ions are transmitted into the ion pulser 120. In other examples, the TOF MS 112 may be on-axis with the path of ions ejected from the ion processing section 108. Also in the present example, the TOF MS 112 includes a single- or multi-stage ion reflector (or reflectron) 132 that turns the path of the ions generally 180 degrees to focus their kinetic energy before their arrival at the detector 128, as appreciated by persons skilled in the art. The resulting ion flight path in this example is generally indicated at 136. In other embodiments, the reflector 132 is not utilized and the ion pulser 120 and detector 128 may be located at opposite ends of the flight tube 124.

The system controller 116 is schematically depicted as representing one or more modules configured for controlling, monitoring and/or timing various functional aspects of the MS system 100 such as, for example, the ion source 104, various components of the ion processing section 108, the ion pulser 120, the ion detector 128, a data recorder 136, and vacuum pumps (not shown). The system controller 116 may also be configured for receiving the ion detection signals from the ion detector 128 and performing tasks relating to data acquisition and signal analysis as necessary to generate a mass spectrum characterizing the sample under analysis, including peak correction as disclosed herein. The system controller 116 may include a computer-readable medium that includes instructions for performing any of the methods disclosed herein. For all such purposes, the system controller 116 is schematically illustrated as being in signal communication with various components of the MS system 100 via wired or wireless communication links represented by lines. Also for these purposes, the system controller 116 may include one or more types of hardware, firmware and/or software, as well as one or more memories and databases. The system controller 116 typically includes a main electronic processor providing overall control, and may include one or more electronic processors configured for dedicated control operations or specific signal processing tasks. The system controller 116 may also schematically represent all voltage sources not specifically shown, as well as timing controllers, clocks, frequency/waveform generators and the like as needed for applying voltages to various components of the MS system 100. The system controller 116 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., logic instructions embodied in software, data, and the like). The system controller 116 may include an operating system (e.g., Microsoft Windows® software) for controlling and managing various functions of the system controller 116.

It will be understood that FIG. 1 is a high-level schematic depiction of the MS system 100 disclosed herein. Other components, such as additional structures, vacuum pumps, gas plumbing, ion optics, ion guides and electronics may be included needed for practical implementations.

Figure 2:
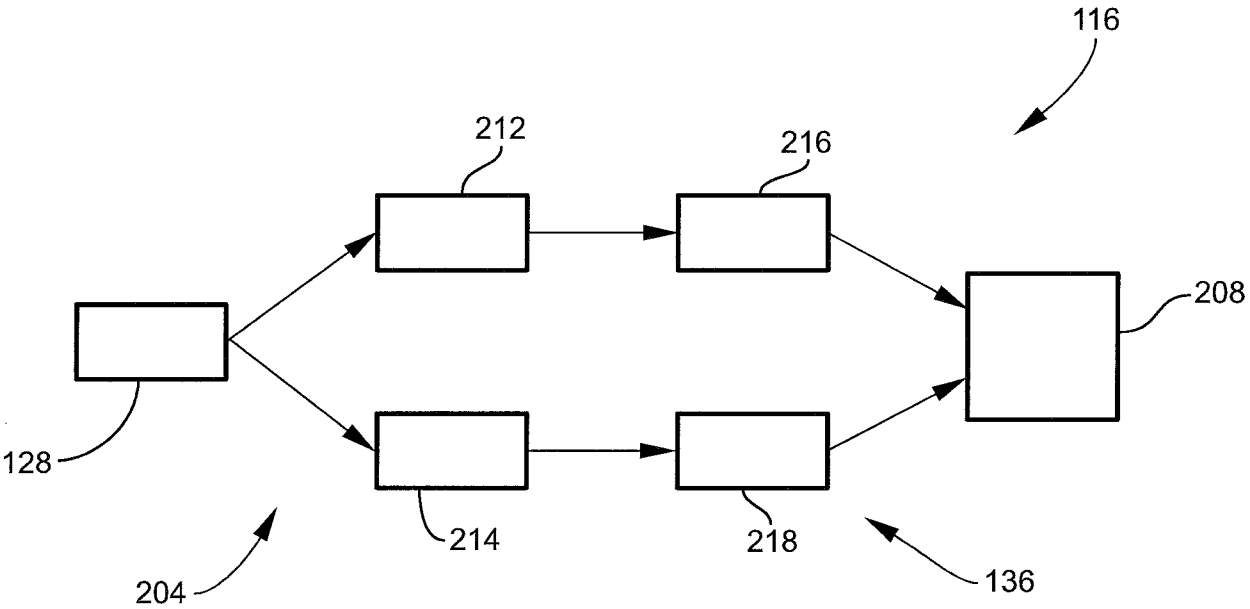
FIG. 2 is a schematic view of an example of components of a system controller and an ion detector that may be included in an MS system.

FIG. 2 is a schematic view of an example of certain components that may be provided with the system controller 116 and ion detector 128. Generally, the detector 128 produces electrical detector output signals in response to ions striking the detector surface, the detector output signals are amplified by an amplifier 204, the amplified signals are accumulated, digitized and stored in memory by the data recorder 136, and the resulting data is processed by a signal processor 208 of the system controller 116. In the illustrated example the signal processor 208 operates to, among other things, perform peak correction as described herein. Depending on the embodiment, the amplifier 204 (or the amplifier 204 and data recorder 136) may be considered as being part of either the ion detector 128 or the system controller 116.

In some embodiments the first stage of the ion detector 128 is a microchannel plate (MCP), the operation of which is understood by persons skilled in the art. When an ion of sufficient energy hits the MCP, multiple electrons are liberated. The electrons are accelerated by an applied voltage and strike a scintillator, which emits photons in response. The photons are focused through optical lenses onto a photomultiplier tube (PMT). The PMT amplifies the number of photons and produces an electrical signal proportional to the number of photons, and this electrical signal is amplified and inputted to the signal processor 208. In this embodiment, the conversion of an electrical signal to an optical signal and back to an electrical signal is useful for electrically isolating the MCP (which may operate in the kV range) from the PMT (which may operate at ground potential). In some embodiments, the data recorder 136 includes an analog-to-digital converter (ADC) that operates as an integrating transient recorder. The ADC samples the amplified detector output at fixed intervals, for example in the nanosecond range (frequency in the GHz range). Each time the system controller 116 signals the ion pulser 120 (FIG. 1) to inject an ion packet into the flight tube 124, the ADC starts to convert the electrical signals outputted from the amplifier 204. With each successive injection of ion packets, the ADC adds the digitized data to those already recorded in memory from the previously recorded transients. The embodiment specifically illustrated is a dual amplifier/dual ADC architecture in which the operations of two amplifiers 212 and 214 and two respective ADCs 216 and 218 are interleaved (alternated). In this manner a maximum effective sampling rate of, for example, 10 GHz ($10\times10^9$ samples per second), is obtained utilizing two ADCs 216 and 218 each having a sampling rate of 5 GHz, thereby extending the dynamic range. An ADC-based data recorder may be desirable because it records multiple ions per transient, enabling it to track ion signal intensity with high accuracy. Alternatively, a time-to-digital converter (TDC) may be utilized.

A method for correcting spectral data in a TOF MS 112 will now be described according to one embodiment. At the start of an experiment, one or more reference compounds are added to the MS system 100 by any means such that the ion source 104 produces both analyte ions from a sample and reference mass (RM) ions from the reference compound(s). That is, the reference compound(s) may be mixed with the sample and the mixture ionized together, or may be ionized separately and the RM ions and analyte ions transferred together into the ion pulser 120. In some embodiments, it is preferred that the RM ions be introduced in enough quantity to produce at least one RM ion in every transient. In some embodiments, it is preferred that at least two RM ions be produced in every transient. In some embodiments, it is preferred that at least one RM ion of a relatively low m/z ratio and at least one RM ion of a relatively high m/z ratio be produced in every transient, such that the RM ions span the m/z range of the analyte ions of the transient. The mixture of analyte ions and RM ions is transferred through the ion processing section 108 and into the ion pulser 120, and ion packets are extracted sequentially by the ion pulser 120 and directed to the ion detector 128, according to the operation of the TOF-based MS system 100.

As analyte ions and RM ions arrive at the detector 128, spectral data is acquired in two modes simultaneously. In the first mode, the signals from individual transients are summed and a compound spectrum is obtained in a normal manner and in normal time intervals (e.g., every 0.02 to 1 second). The centroids of the RM peaks in the compound spectrum are then measured and recorded. The resulting data set is referred to herein as "averaged peak centroids" or APC.

In the second mode, the data from each individual transient is recorded at the same time the data from the individual transients are summed as described above. Then, for each individual transient spectrum recorded, the positions of the RM peaks are compared to the corresponding RM centroids of the APC to determine the time shifts in the RM peaks. The systematic shifts of the single transient peaks found in this manner reflect the contributions from the group I factors, described above.

The shifts in RM peak positions are then utilized to determine the time correction to be made to all other peaks (i.e., the analyte, or target, peaks) in the individual transient spectrum. Each individual transient spectrum recorded is corrected in this manner. After each individual transient spectrum is corrected, they are summed together to obtain a "corrected averaged spectrum" or CAS. Through implementation of this method, the peak widths in the CAS are reduced as if the group I factors were absent in the MS system 100, which may significantly increase mass resolution. The overall enhancement in mass resolution may depend on the ratio between the group I and group II factors associated with the MS system 100.

The peak correction according to this method may be generated in the form of an appropriate correction function or algorithm that is applied to each individual transient spectrum to obtain respective corrected transient spectra, which are then summed as noted above. In some embodiments, adjustment values are determined based on comparing the positions of the RM peaks to the corresponding RM centroids of the APC, and these adjustment values are inputted into variables of the correction function that is applied to the uncorrected transient spectra. The adjustment values may be, or be derived from, the time shift determined for each m/z ratio of the detected target (analyte) ions.

The shifts that peaks experience due to the group I factors may be subdivided into two groups, group Ia and group Ib. Group Ia includes effects such as pulser jitter that move the peaks by the same time value independently of m/z ratio. Group Ib includes effects such as voltage instability and system vibration that move the peaks by an amount dependent on m/z ratio (and typically proportional to the square root of the m/z ratio). According to some embodiments, to make a correct adjustment for a target peak, the shifts for two or more RM peaks should be measured. Then, interpolation between those values may be made, with m/z (or time-of-flight) values utilized as weighting parameters. The amount of weighting may vary among different MS systems (particularly among different TOF analyzer instruments). Accordingly, in some embodiments the determination of the time shift is based on the measured peak positions of the target ion m/z ratio and at least two RM ion m/z ratios, and on the respective time shifts of the two RM ions. As one non-limiting example, the time shift, $\Delta t_{TM}$, may be determined from the following equation in case of n RM ions, where n is an integer equal to 1 or greater:

$$\Delta t_{TM} = \frac{1}{n}(1+\alpha)\frac{\Delta t_{RM1}}{\left(1+\alpha\frac{TOF_{RM1}}{TOF_{TM}}\right)} + \frac{\Delta t_{RM2}}{\left(1+\alpha\frac{TOF_{RM2}}{TOF_{TM}}\right)} + \ldots + \frac{\Delta t_{RMn}}{\left(1+\alpha\frac{TOF_{RMn}}{TOF_{TM}}\right)}$$

where $\alpha$ is a weighting factor dependent on the TOF MS (i.e., determined by the relative contributions of factors that shift peak positions), $\Delta t_{RM1}$, $\Delta t_{RM2}$ and $\Delta t_{RMn}$ are the respective time shifts of the reference m/z ratios utilized, $TOF_{TM}$ is the measured peak position of the target m/z ratio, and $TOF_{RM1}$, $TOF_{RM2}$, and $TOF_{TMn}$ are the respective measured peak positions of the reference m/z ratios. If the shifts are generally independent of m/z ratio (as in the case of, for example, puller jitter), then the weighting factor would tend to be small ($\alpha \ll 1$). In the opposite case of a large contribution of factors that shift peaks in proportion to the corresponding TOF values, then the weighting factor $\alpha$ would be greater than 1. The optimum value for a thus depends on the properties of the specific MS system.

The approach of determining the positions of RM peaks based on a single transient signal may be considered as introducing another component to the peak width, insofar as two contributions (from RM peak and target peak) of the group II nature are present. However, any detrimental effect of this added contribution may be reduced or eliminated by ensuring that each transient receives more than one RM ion hit. This may be achieved by increasing the supply of RM material into the MS system 100. As a result, the final peak width would only have the width associated with uncertainty in the target ion peak position measurement due to group II factors. The positions of RM peaks are detected with better confidence in the individual transient spectra due to averaging.

Figure 3:
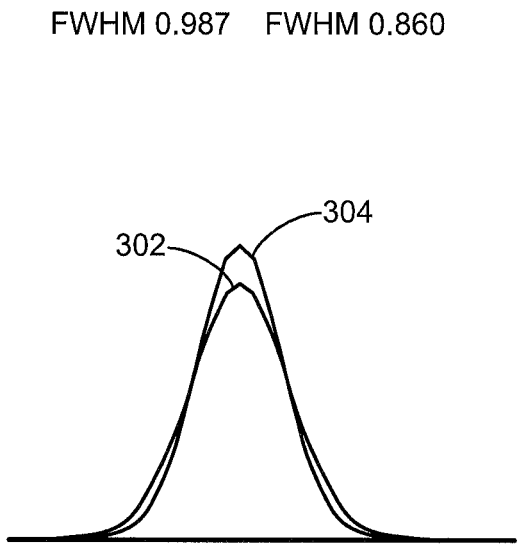
FIG. 3 is an example of a simulated uncorrected peak and corrected peak of an analyte ion having an m/z ratio of around 600 when RM ions of m/z ratios of 100 and 900 are utilized in accordance with the methods disclosed herein.
Figure 4:
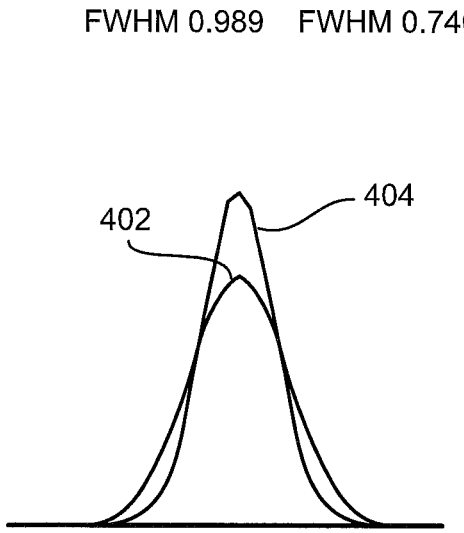
FIG. 4 is an example of a simulated uncorrected peak and corrected peak of an analyte ion when five RM ions per transient are utilized in accordance with the methods disclosed herein.

FIG. 3 is an example of a simulated uncorrected (normally acquired) peak 302 and a corrected peak 304 of an analyte ion of an m/z ratio of around 600 when RM ions of m/z ratios of 100 and 900 are utilized in accordance with the methods disclosed herein. The horizontal axis is m/z value and the vertical axis is intensity (abundance) value. The uncorrected peak 302 has an FWHM (full width half maximum) of 0.987 while the corrected peak 304 has an FWHM of 0.860. The difference in peak width corresponds to an improvement in mass resolution of 15%. Similarly, FIG. 4 is an example of a simulated uncorrected peak 402 and corrected peak 404 of an analyte ion when five RM ions per transient are utilized. The uncorrected peak 402 has an FWHM of 0.999 while the corrected peak 404 has an FWHM of 0.748. In this case the resolution gain is 35%. It will be noted that the examples illustrated in FIGS. 3 and 4 utilized a nanosecond as a measure of time and assumed a sampling rate of 10 GHz.

It will be noted that the amount of resolution gain would increase if the weight of the group I factors were higher than the weight utilized in the examples of FIGS. 3 and 4. This may be achieved by taking steps to reduce the group II factors such as, for example, reducing the turn-around time (e.g., by cooling and compressing the ion beam), utilizing an ion detector with a flatter surface, reducing mechanical misalignments or providing an aperture or other means to reduce the effect of mechanical misalignments, etc.

In the case of a TOF MS having a very long flight length (e.g., a multi-reflection or multi-turn TOF MS), the weight of the group I factors may be significantly higher than that of the group II factors due to the fact that the contribution of the group I factors to the peak width increases in proportion to the flight time of the ions. On the other hand, the contribution of the group II factors generally does not change with increasing flight time. Therefore, in the case of a relatively long flight length the gain in resolution resulting from the methods disclosed herein may be particularly significant. At the same time, however, the compensation of system instabilities may generally be achieved most effectively if the typical time of variation in the system's parameters is substantially longer than the total flight time. The total flight time in a TOF MS having a very long flight length is relatively long, implying that the goal of efficient compensation of system instabilities may be harder to achieve in this type of TOF MS. Hence, the effectiveness of the methods disclosed herein may depend on specific instrument parameters that define the ion flight time. One mitigating circumstance in experiments involving analyte ions of small m/z ratios (e.g., experiments relating to metabolomics) is that ions of smaller m/z ratios have shorter time-of-flight values, and can therefore be less sensitive to short-period instrument instabilities.

Figure 5:
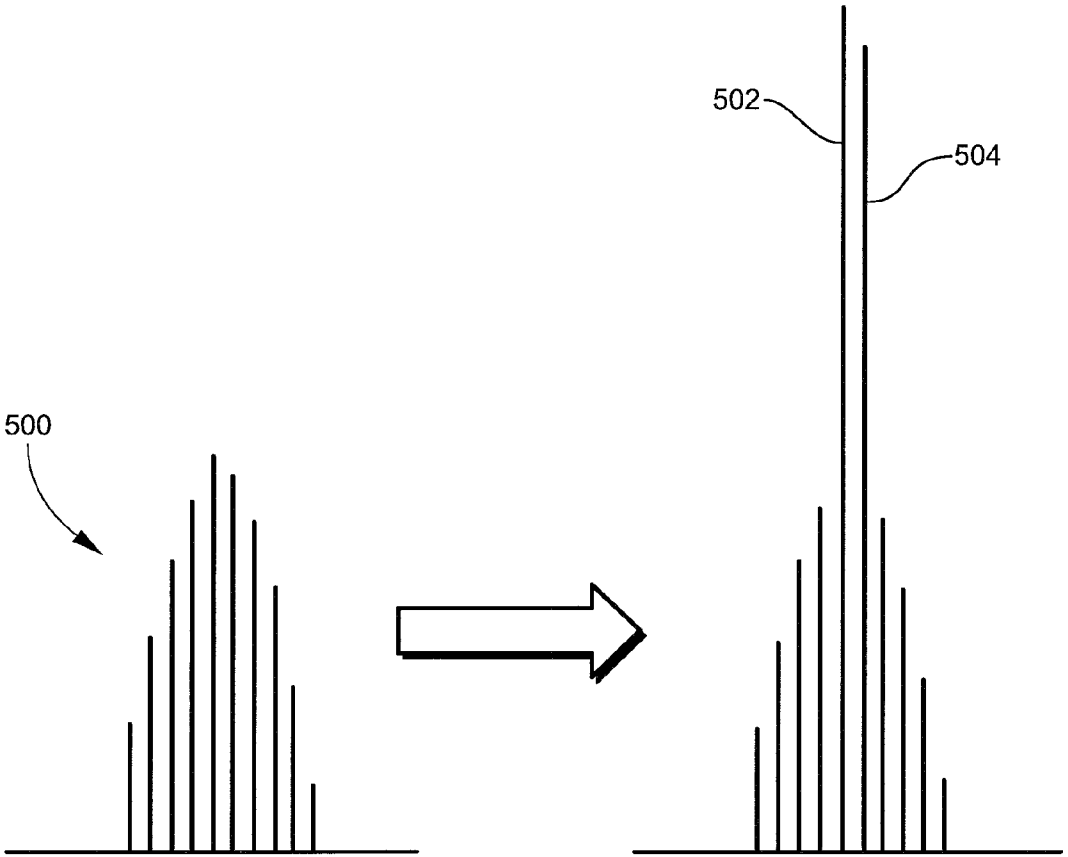
FIG. 5 illustrates an original peak profile and modified profile with just two datapoints left.

As described above, the second mode of data acquisition entails storing and processing the data in each individual transient. In some embodiments the amount of data, if in the form of profile data, may be too excessive to be able to practicably record in real time. In this case, instead of storing and processing profile data for each individual transient, only the peak positions (centroids) and intensities (abundances) of the individual peaks could be stored and processed, thereby greatly reducing the amount of data processed. In another example, the recording of the individual transient spectrum may be compressed as follows. As the ion peak in each transient is digitized (at, for example, a 10 GHz sampling rate), the centroid of the peak is found. Then only two points around the centroid are retained in memory, and all others are set to zero. The abundance of both points is adjusted so that the position of the peak's centroid remains intact, and the total abundance of the peak is preserved as well. This technique is illustrated in FIG. 5, which shows an original peak profile 500 and the two points 502 and 504 that are preserved in memory. A point on the peak profile on either side of the centroid is retained. Because only two points per peak are kept the amount of non-zero data in the spectrum is reduced drastically, and execution of a simple compression algorithm is able to compress the data to a reasonably small size. The foregoing examples of data reduction may be performed for every individual transient spectrum before they are summed and corrected.

Figure 6:
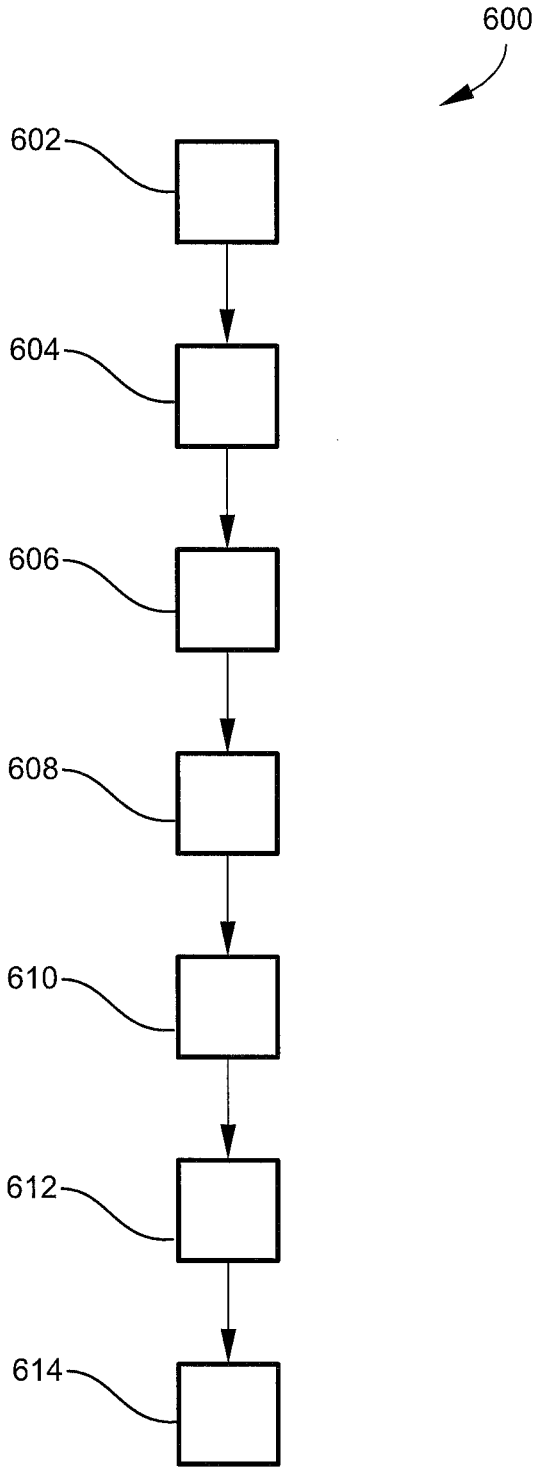
FIG. 6 is a flow diagram illustrating an example of a method for correcting spectral data in a TOF MS, and/or an example of an MS system configured for correcting spectral data in accordance with the method.

FIG. 6 is a flow diagram 600 illustrating an example of a method for correcting spectral data in a TOF MS. A mixture of analyte ions and one or more reference mass (RM) ions are introduced into the TOF MS (block 602). A plurality of transient spectra comprising analyte peaks corresponding to detected analyte ions and one or more RM peaks corresponding to one or more detected RM ions are recorded (block 604). The recorded transient spectra are then summed to obtain a compound spectrum (block 606). The centroids of the RM peaks of the compound spectrum are then calculated to obtain a set of averaged peak centroids (APC) (block 608). The positions of one or more RM peaks in each recorded transient spectrum are compared to corresponding RM centroids in the APC (block 610). Based on the comparison, a correction function is applied to the respective recorded transient spectra to obtain respective corrected transient spectra (block 612). Finally, the corrected transient spectra are summed to obtain a corrected averaged spectrum (CAS) comprising corrected peaks of the analyte ions detected (block 614).

According to another embodiment, the flow diagram 600 of FIG. 6 may also represent an apparatus or system configured for performing the illustrated method. Accordingly, FIG. 6 may be considered as schematically illustrating an MS system. In this embodiment, the blocks 602-614 may be considered as depicting one or more devices or means for performing the functions, operations, or steps corresponding to the blocks 602-614 as described above. Examples of an apparatus or system configured for implementing these functions include, but are not limited to, those described above in conjunction with FIGS. 1 and 2. Depending on the function, operation or step associated with a given block illustrated in FIG. 6, that function, operation or step may be implemented by hardware and/or software, including appropriate machine-executable instructions as may be stored on a computer storage medium. The computer storage medium may be interfaced with (e.g., loaded into) and readable by a computing device, which may be a component of (or at least in communication with) a suitable electronic processor-based device or system such as, for example, the system controller 116 schematically illustrated in FIG. 1 and partially illustrated in FIG. 2.

According to another embodiment, an MS system is provided that includes a system controller communicating with a TOF MS, and configured to perform any of the methods disclosed herein, or one or more steps of the methods. In the present context, the term "perform" encompasses actions such as controlling and/or signal or data transmission. For example, the system controller may perform a method step by controlling another component involved in performing the method step. Performing or controlling may involve making calculations, or sending and/or receiving signals (e.g., control signals, instructions, measurement signals, parameter values, data, etc.) Non-limiting examples of the system controller and TOF MS are described above and illustrated in FIGS. 1, 2 and 6.

According to another embodiment, a computer-readable storage medium is provided that includes instructions for performing (or controlling), in whole or in part, any of the methods disclosed herein. According to another embodiment, an MS system is provided that includes the computer-readable storage medium.

According to another embodiment, an MS system is provided that includes a TOF MS and a system controller, non-limiting examples of which are described above and illustrated in FIGS. 1, 2 and 6. The TOF MS includes an ion detector configured for detecting the arrival of analyte ions and reference mass (RM) ions. In some embodiments, the system controller includes a recorder and a processor. The recorder may be configured for receiving signals from the ion detector corresponding to detection of analyte ions and RM ions, and recording a plurality of transient spectra comprising analyte peaks corresponding to detected analyte ions and one or more RM peaks corresponding to one or more detected RM ions. The processor may be configured for performing transient-level data acquisition and peak correction as described herein.

EXEMPLARY EMBODIMENTS

Exemplary embodiments provided in accordance with the presently disclosed subject matter include, but are not limited to, the following:

1. A method for correcting spectral data in a time-of-flight mass spectrometer (TOF MS), the method including: introducing a mixture of analyte ions and one or more reference mass (RM) ions into the TOF MS; recording a plurality of transient spectra comprising analyte peaks corresponding to detected analyte ions and one or more RM peaks corresponding to one or more detected RM ions; summing the recorded transient spectra to obtain a compound spectrum; centroiding the RM peaks of the compound spectrum to obtain a set of averaged peak centroids (APC); comparing positions of one or more RM peaks in each recorded transient spectrum to corresponding RM centroids in the APC; based on the comparison, applying a correction function to the respective recorded transient spectra to obtain respective corrected transient spectra; and summing the corrected transient spectra to obtain a corrected averaged spectrum comprising corrected peaks of the analyte ions detected.

2. The method of embodiment 1, wherein for each analyte peak detected, recording the transient spectrum comprises recording data selected from the group consisting of: profile data; and centroid position and intensity.

3. The method of embodiment 1 or 2, wherein each analyte peak detected comprises a plurality of data points, and for each analyte peak detected, recording the transient spectrum comprises finding a centroid of the analyte peak, retaining a first data point on a first side of the centroid, retaining a second data point on a second side of the centroid, setting all other data points to zero, and adjusting respective intensities of the first data point and the second data point such that a position of the centroid and a total intensity of the analyte peak are preserved.

4. The method of any of embodiments 1-3, comprising, based on the comparison, determining respective adjustment values to be utilized to correct the respective recorded spectra, wherein for each recorded transient spectrum the correction function is applied utilizing the adjustment values determined for that recorded transient spectrum.

5. The method of embodiment 4, wherein determining respective adjustment values comprises determining a time shift for each target m/z ratio of the detected analyte ions.

6. The method of embodiment 5, wherein determining the time shift for each target m/z ratio is based on measured peak positions of the target m/z ratio and one or more reference m/z ratios, and on respective time shifts of the one or more reference m/z ratios.

7. The method of embodiment 6, wherein the time shift for each target m/z ratio, $\Delta t_{TM}$, is determined according to the following equation:

$$\Delta t_{TM} = \frac{1}{n}(1+\alpha)\frac{\Delta t_{RM1}}{\left(1+\alpha\frac{TOF_{RM1}}{TOF_{TM}}\right)} + \frac{\Delta t_{RM2}}{\left(1+\alpha\frac{TOF_{RM2}}{TOF_{TM}}\right)} + \ldots + \frac{\Delta t_{RMn}}{\left(1+\alpha\frac{TOF_{RMn}}{TOF_{TM}}\right)},$$

wherein $\alpha$ is a weighting factor dependent on the TOF MS, $\Delta t_{RM1}$, $\Delta t_{RM2}$ and $\Delta t_{RMn}$ are the respective time shifts of the reference m/z ratios utilized, $TOF_{TM}$ is the measured peak position of the target m/z ratio, and $TOF_{RM1}$, $TOF_{RM2}$, and $TOF_{TMn}$ are the respective measured peak positions of the reference m/z ratios.

8. The method of any of embodiments 1-7, wherein introducing the mixture comprises supplying the one or more RM ions in a quantity sufficient that RM ions of at least two different m/z ratios are detected in each recorded transient spectrum.

9. A mass spectrometry system, including a system controller communicating with the TOF MS, and configured to perform the method of any of embodiments 1-8.

10. A computer-readable storage medium including instructions for performing any of embodiments 1-8.

11. A mass spectrometry system including the computer-readable storage medium of embodiment 10.

12. A mass spectrometry system, including a TOF MS and a system controller. The TOF MS includes an ion detector configured for detecting the arrival of analyte ions and reference mass (RM) ions. In some embodiments, the system controller includes a recorder and a processor. The recorder may be configured for receiving signals from the ion detector corresponding to detection of analyte ions and RM ions, and recording a plurality of transient spectra comprising analyte peaks corresponding to detected analyte ions and one or more RM peaks corresponding to one or more detected RM ions. The processor may be configured for: summing the recorded transient spectra to obtain a compound spectrum; centroiding the RM peaks of the compound spectrum to obtain a set of averaged peak centroids (APC); comparing positions of one or more RM peaks in each recorded transient spectrum to corresponding RM centroids in the APC; based on the comparison, applying a correction function to the respective recorded transient spectra to obtain respective corrected transient spectra; and summing the corrected transient spectra to obtain a corrected averaged spectrum comprising corrected peaks of the analyte ions detected.

13. The mass spectrometry system of embodiment 12, wherein the processor configured for, based on the comparison, determining respective adjustment values to be utilized to correct the respective recorded spectra, wherein for each recorded transient spectrum the correction function is applied utilizing the adjustment values determined for that recorded transient spectrum.

14. The mass spectrometry system of embodiment 13, wherein the processor is configured for determining a time shift for each target m/z ratio of the detected analyte ions.

15. The mass spectrometry system of embodiment 14, wherein the processor is configured for determining the time shift for each target m/z ratio based on measured peak positions of the target m/z ratio and one or more reference m/z ratios, and on respective time shifts of the one or more reference m/z ratios.

16. The mass spectrometry system of embodiment 15, wherein the processor is configured for determining the time shift for each target m/z ratio, $\Delta t_{TM}$, according to the following equation:

$$\Delta t_{TM} = \frac{1}{n}(1+\alpha)\frac{\Delta t_{RM1}}{\left(1+\alpha\frac{TOF_{RM1}}{TOF_{TM}}\right)} + \frac{\Delta t_{RM2}}{\left(1+\alpha\frac{TOF_{RM2}}{TOF_{TM}}\right)} + \ldots + \frac{\Delta t_{RMn}}{\left(1+\alpha\frac{TOF_{RMn}}{TOF_{TM}}\right)},$$

wherein $\alpha$ is a weighting factor dependent on the TOF MS, $\Delta t_{RM1}$, $\Delta t_{RM2}$ and $\Delta t_{RMn}$ are the respective time shifts of the reference m/z ratios utilized, $TOF_{TM}$ is the measured peak position of the target m/z ratio, and $TOF_{RM1}$, $TOF_{RM2}$, and $TOF_{TMn}$ are the respective measured peak positions of the reference m/z ratios.

17. The mass spectrometry system of any of embodiments 12-16, wherein the ion detector comprises a microchannel plate.

18. The mass spectrometry system of any of embodiments 12-16, wherein the recorder comprises an analog-to-digital converter.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the system controller 116 schematically depicted in FIG. 1. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the system controller 116 in FIG. 1), direct the electronic system to carry out the instructions. The computer program product may be selectively embodied in any non-transitory computer-readable storage medium for use by or in connection with an instruction execution system, apparatus, or device, such as a electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program can be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for correcting spectral data in a time-of-flight mass spectrometer (TOF MS), the method comprising:

(a) introducing a mixture of analyte ions and one or more reference mass (RM) ions into the TOF MS;

(b) recording a plurality of transient spectra comprising analyte peaks corresponding to detected analyte ions and one or more RM peaks corresponding to one or more detected RM ions;

(c) summing the recorded transient spectra to obtain a compound spectrum;

(d) centroiding the RM peaks of the compound spectrum to obtain a set of averaged peak centroids (APC);

(e) comparing positions of one or more RM peaks in each recorded transient spectrum to corresponding RM centroids in the APC;

(f) based on the comparison, applying a correction function to the respective recorded transient spectra to obtain respective corrected transient spectra; and (g) summing the corrected transient spectra to obtain a corrected averaged spectrum comprising corrected peaks of the analyte ions detected.

2. The method of claim 1, wherein for each analyte peak detected, recording the transient spectrum comprises recording data selected from the group consisting of: profile data; and centroid position and intensity.

3. The method of claim 1, wherein each analyte peak detected comprises a plurality of data points, and for each analyte peak detected, recording the transient spectrum comprises finding a centroid of the analyte peak, retaining a first data point on a first side of the centroid, retaining a second data point on a second side of the centroid, setting all other data points to zero, and adjusting respective intensities of the first data point and the second data point such that a position of the centroid and a total intensity of the analyte peak are preserved.

4. The method of claim 1, comprising, based on the comparison, determining respective adjustment values to be utilized to correct the respective recorded spectra, wherein for each recorded transient spectrum the correction function is applied utilizing the adjustment values determined for that recorded transient spectrum.

5. The method of claim 4, wherein determining respective adjustment values comprises determining a time shift for each target m/z ratio of the detected analyte ions.

6. The method of claim 5, wherein determining the time shift for each target m/z ratio is based on measured peak positions of the target m/z ratio and one or more reference m/z ratios, and on respective time shifts of the one or more reference m/z ratios.

7. The method of claim 6, wherein the time shift for each target m/z ratio, $\Delta t_{TM}$, is determined according to the following equation:

$$\Delta t_{TM} = \frac{1}{n}(1+\alpha)\frac{\Delta t_{RM1}}{\left(1+\alpha\frac{TOF_{RM1}}{TOF_{TM}}\right)} + \frac{\Delta t_{RM2}}{\left(1+\alpha\frac{TOF_{RM2}}{TOF_{TM}}\right)} + \ldots + \frac{\Delta t_{RMn}}{\left(1+\alpha\frac{TOF_{RMn}}{TOF_{TM}}\right)},$$

wherein $\alpha$ is a weighting factor dependent on the TOF MS, $\Delta t_{RM1}$, $\Delta t_{RM2}$ and $\Delta t_{RMn}$ are the respective time shifts of the reference m/z ratios utilized, $TOF_{TM}$ is the measured peak position of the target m/z ratio, and $TOF_{RM1}$, $TOF_{RM2}$, and $TOF_{TMn}$ are the respective measured peak positions of the reference m/z ratios.

8. The method of claim 1, wherein introducing the mixture comprises supplying the one or more RM ions in a quantity sufficient that RM ions of at least two different m/z ratios are detected in each recorded transient spectrum.

9. A mass spectrometry system, comprising a system controller communicating with the TOF MS, and configured for performing steps (b) to (g) of claim 1.

10. A computer-readable storage medium comprising instructions for performing steps (b) to (g) of claim 1.

11. A mass spectrometry system, comprising a time-of-flight mass spectrometer and the computer-readable storage medium of claim 10.

12. A mass spectrometry system, comprising:

a time-of-flight mass spectrometer comprising an ion detector configured for detecting the arrival of analyte ions and reference mass (RM) ions; and a system controller comprising:

a recorder configured for receiving signals from the ion detector corresponding to detection of analyte ions and RM ions, and recording a plurality of transient spectra comprising analyte peaks corresponding to detected analyte ions and one or more RM peaks corresponding to one or more detected RM ions; and a processor configured for:

summing the recorded transient spectra to obtain a compound spectrum;

centroiding the RM peaks of the compound spectrum to obtain a set of averaged peak centroids (APC);

comparing positions of one or more RM peaks in each recorded transient spectrum to corresponding RM centroids in the APC;

based on the comparison, applying a correction function to the respective recorded transient spectra to obtain respective corrected transient spectra; and summing the corrected transient spectra to obtain a corrected averaged spectrum comprising corrected peaks of the analyte ions detected.

13. The mass spectrometry system of claim 12, wherein the processor configured for, based on the comparison, determining respective adjustment values to be utilized to correct the respective recorded spectra, wherein for each recorded transient spectrum the correction function is applied utilizing the adjustment values determined for that recorded transient spectrum.

14. The mass spectrometry system of claim 13, wherein the processor is configured for determining a time shift for each target m/z ratio of the detected analyte ions.

15. The mass spectrometry system of claim 14, wherein the processor is configured for determining the time shift for each target m/z ratio based on measured peak positions of the target m/z ratio and one or more reference m/z ratios, and on respective time shifts of the one or more reference m/z ratios.

16. The mass spectrometry system of claim 15, wherein the processor is configured for determining the time shift for each target m/z ratio, $\Delta t_{TM}$, according to the following equation:

$$\Delta t_{TM} = \frac{1}{n}(1+\alpha)\frac{\Delta t_{RM1}}{\left(1+\alpha\frac{TOF_{RM1}}{TOF_{TM}}\right)} + \frac{\Delta t_{RM2}}{\left(1+\alpha\frac{TOF_{RM2}}{TOF_{TM}}\right)} + \ldots + \frac{\Delta t_{RMn}}{\left(1+\alpha\frac{TOF_{RMn}}{TOF_{TM}}\right)},$$

wherein $\alpha$ is a weighting factor dependent on the TOF MS, $\Delta t_{RM1}$, $\Delta t_{RM2}$ and $\Delta t_{RMn}$ are the respective time shifts of the reference m/z ratios utilized, $TOF_{TM}$ is the measured peak position of the target m/z ratio, and $TOF_{RM1}$, $TOF_{RM2}$, and $TOF_{TMn}$ are the respective measured peak positions of the reference m/z ratios.

17. The mass spectrometry system of claim 12, wherein the ion detector comprises a microchannel plate.

18. The mass spectrometry system of claim 12, wherein the recorder comprises an analog-to-digital converter.

* * * * *